US005503093A

United States Patent [19]

Katou

[11] Patent Number: 5,503,093

[45] Date of Patent: Apr. 2, 1996

[54] EMBROIDERING-FRAME DRIVING DEVICE FOR A SEWING MACHINE AND METHOD OF CONTROLLING THE DEVICE

[75] Inventor: Yutaka Katou, Kariya, Japan

[73] Assignee: Aisin Seiki Kabushiki Kaisha, Tokyo, Japan

[21] Appl. No.: 363,004

[22] Filed: Dec. 22, 1994

[30] Foreign Application Priority Data

Dec. 22, 1993 [JP] Japan ..... 5-524793

[51] Int. Cl.[6] ..... D05C 9/04; D05B 21/00

[52] U.S. Cl. ..... 112/103; 112/475.18

[58] Field of Search ..... 112/121.12, 103, 112/102, 86, 78, 121.15, 262.3, 266.1, 121.11, 102.5, 470.06, 470.09, 470.14, 475.18, 475.19, 475.04

[56] References Cited

U.S. PATENT DOCUMENTS 4,503,788 3/1985 Giannuzzi ..... 112/121.12
4,598,655 7/1986 Takenoya ..... 112/103
4,735,159 4/1988 Brussel et al. ..... 112/121.12
5,012,752 5/1991 Murata et al. ..... 112/121.12

*Primary Examiner*—Peter Nerbun
*Attorney, Agent, or Firm*—Sughrue, Mion, Zinn, Macpeak & Seas

[57] ABSTRACT

An embroidering-frame driving device for a sewing machine comprises: an embroidering frame for holding cloth stretched tight; an embroidering-frame holder; a driving motor for driving the embroidering-frame holder in one direction with respect to the sewing needle; and a rotating motor for rotating the embroidering frame with respect to the embroidering-frame holder. In the device, for each of the sewing points forming an embroidery pattern, the rotating motor is turned until the sewing point comes to a straight line which is extended in the one direction passing through the sewing needle, and the driving motor is driven until the sewing point is moved from the straight line to come under the sewing needle.

5 Claims, 5 Drawing Sheets

EMBROIDERING-FRAME DRIVING DEVICE FOR A SEWING MACHINE AND METHOD OF CONTROLLING THE DEVICE

BACKGROUND OF THE INVENTION

1. Field of the Invention

This invention relates to an embroidering-frame driving device for a sewing machine, and a method of controlling the device.

2. Discussion of the Related Art

An embroidering-frame driving device has been developed for a sewing machine which moves with respect to the sewing needle an embroidering frame to which a piece of cloth has fastened tight, so that a given pattern is embroidered on the piece of cloth. An embroidering-frame driving device of this type has been disclosed, for instance, by Japanese Patent Examined Publication No. Sho 60-42740, Japanese Utility Model Examined Publication No. Sho 61-40289 and U.S. Pat. No. 5,003,895. The conventional embroidering-frame driving device has an X-axis and Y-axis which are orthogonal with each other. The embroidering frame is moved in the directions of X-axis and Y-axis so that the piece of cloth fastened to the embroidering frame is moved in a horizontal plane with respect to the sewing needle.

The conventional embroidering-frame driving device, being operated on the X- and Y-axes, is unavoidably intricate in structure, and accordingly high in manufacturing cost. In addition, the device is large in frame drive weight, which makes it impossible to increase the sewing speed (rpm). Furthermore, the sewing machine equipped with the device is bulky, requiring a large installation space.

SUMMARY OF THE INVENTION

In view of the foregoing, an object of the invention is to provide an embroidering-frame driving device for a sewing machine which is light in weight, compact, and can be operated at high speed.

The foregoing object of the invention have been achieved by the provision of an embroidering-frame driving device for a sewing machine, which comprises: an embroidering frame for holding cloth stretched tight; an embroidering-frame holder for holding the embroidering frame; a driving motor for driving the embroidering-frame holder in one direction with respect to the sewing needle of the sewing machine; and a rotating motor for rotating the embroidering frame with respect to the embroidering-frame holder.

In the device, the rotating motor is rotated to turn the embroidering frame with respect to the embroidering-frame holder; and the driving motor is turned to move the embroidering-frame holder in one direction with respect to the sewing needle. Thus, the embroidering frame is moved as a composition of rotary motion and linear motion. That is, it is unnecessary to move the embroidering frame in a direction perpendicular to the one direction, and therefore the range of movement of the embroidering frame is reduced to substantially a half of that in the conventional device operating on the X- and Y-axes.

Also, the foregoing object of the invention have been achieved by the provision of a method of controlling the above-described embroidering-frame driving device, in which, for each of sewing points forming an embroidery pattern, the rotating motor is turned until each sewing point comes to a straight line which is extended in the one direction passing through the sewing needle, and the driving motor is driven until each sewing point is moved from the straight line to come under the sewing needle.

In the method, for each of the sewing points, the rotating motor is driven so that the sewing point comes to the straight line. After the sewing point reaches the straight line, the driving motor is operated to move the sewing point until it comes under the sewing needle.

The nature, utility and principle of the invention will be more clearly understood from the following detailed description and the appended claims when read in conjunction with the accompanying drawings.

DETAILED DESCRIPTION OF THE INVENTION

Figure 1:
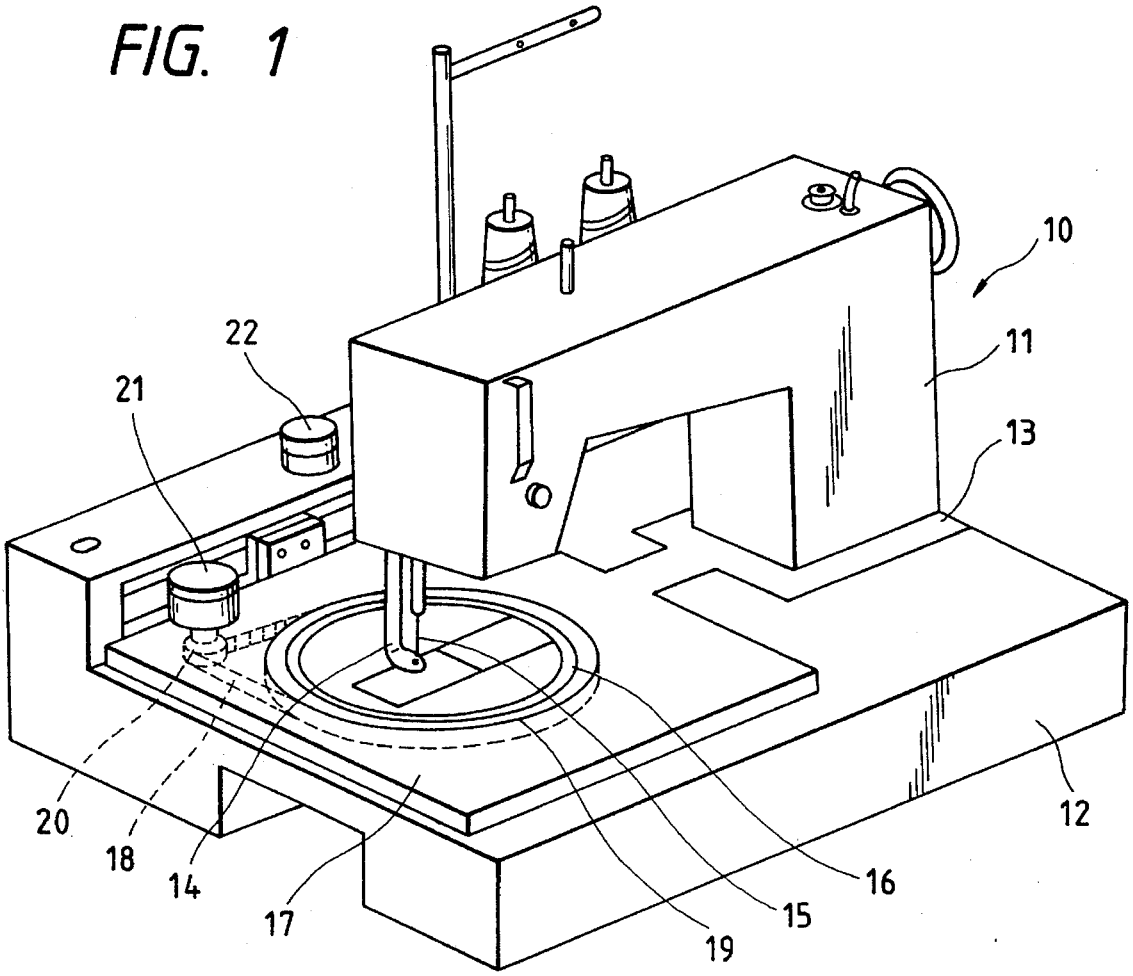
FIG. 1 is a perspective view showing a sewing machine equipped with an embroidering-frame driving device according to an embodiment of the invention.

An embroidering-frame driving device for a sewing machine is as shown in FIG. 1, which constitutes an embodiment of the invention.

The sewing machine 10, as shown in FIG. 1, has an arm 11, a base 12, a bed 13, a cloth presser 14, and a needle 15. The bed 13 is set on the base 12. The arm 11 is secured to the bed 13, and has the cloth presser 14 and the needle 15 at the end. The needle 15 is moved up and down with respect to the arm 11, to sew cloth.

The embroidering-frame driving device includes a cylindrical embroidering frame 16, an embroidering-frame holder 17, a timing belt 18, a cylindrical timing pulley, a rotary pulley 20, a rotating motor 21, and a driving motor 22. The driving motor 22 is adapted to drive the embroidering-frame holder 17 in the direction of X-axis (in one direction) with respect to the base 12. The embroidering-frame holder 17 has a cylindrical space in which the cylindrical timing pulley 19 is fitted. The rotating motor 21 is fixedly mounted on the embroidering-frame holder 17, to rotate the rotary pulley 20. The timing belt 18 is laid over the timing pulley 19 and the rotary pulley 20. Hence, as the rotating motor 21 is rotated, the timing pulley 19 is driven through the rotary pulley 20 and the timing belt 18. The cylindrical embroidering frame 16 is fitted in the timing pulley 19. Cloth is held tight between the embroidering frame 16 and the timing pulley 19.

The arrangement of the embroidering-frame driving device will be described with reference to FIGS. 2 and 3 in more detail.

A driving pulley 26 is fixedly mounted on the rotary shaft 33 of the driving motor 22. As shown in FIG. 3, a driven pulley 34 is rotatably mounted on the base 12 of the sewing machine 10, and a timing belt 24 is laid over the driven pulley 34 and the driving pulley 26. The embroidering-frame holder 17 is fixedly fastened to the timing belt at a point with a fixing member 36.

Hence, as the motor 22 is rotated, the timing belt 24 is driven, so that the embroidering-frame holder 17 is moved in one direction with respect to the base 12. The fixing member 36, as shown in FIG. 2, comprises a belt fastener 25, a coupling member 27, a moving stand 28, and a rail 29. The rail is extended in one direction, and fixedly secured to the base 12. The moving stand 28 is slidably mounted on the rail 29. The coupling member 27 is fixedly fastened to the timing belt 24 with the belt fastener 25. The coupling member 27 is further fixedly connected to the embroidering-frame holder 17 and the moving stand 28. Hence, as the motor 22 rotates, the embroidering-frame hole 17 is moved in the one direction along the rail 29 together with the moving stand 29.

Figure 2:
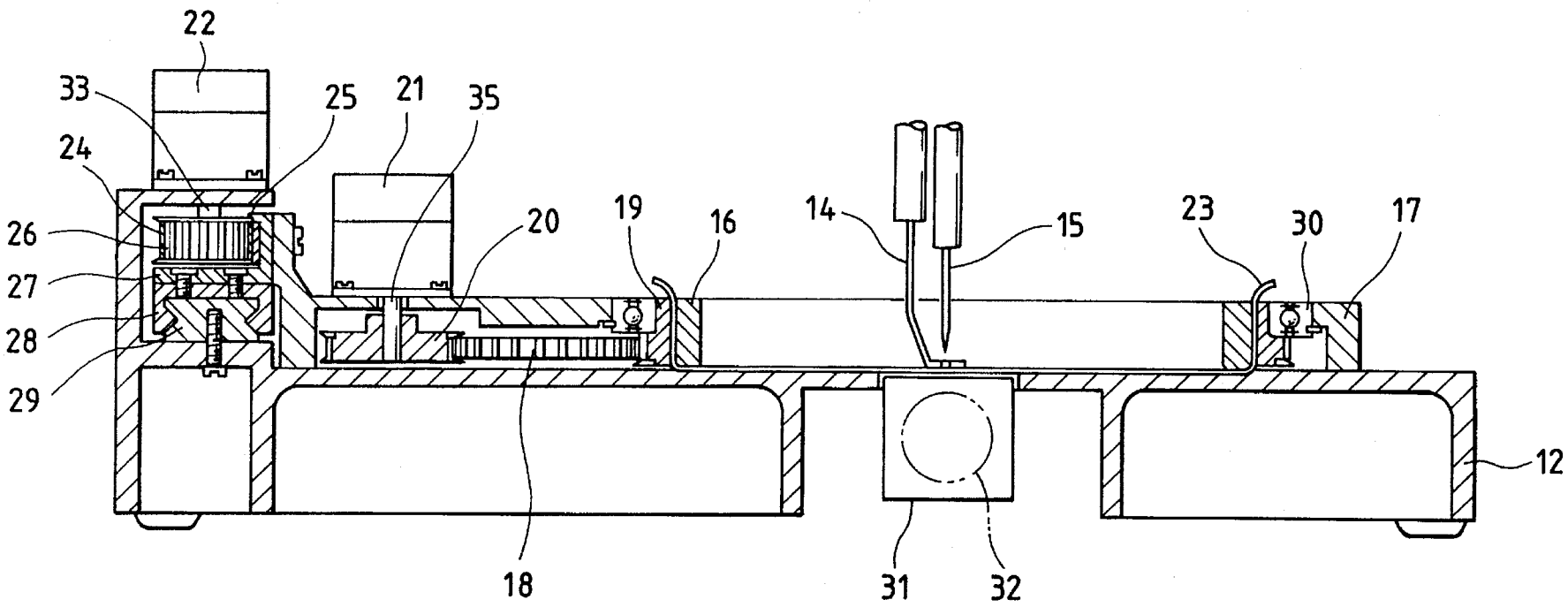
FIG. 2 is a sectional view of the embroidering-frame driving device shown in FIG. 1.

As shown in FIG. 2, the timing pulley 19 is rotatably held in the embroidering-frame holder 17 through ball bearings 30. As was described before, the rotary pulley 20 is fixedly mounted on the rotary shaft 35 of the rotating motor 21, and the timing belt 18 is laid over the rotary pulley 20 and the timing pulley 19. Therefore, as the rotating motor 21 is rotated, the timing belt 18 is driven to turn the timing pulley 19 with respect to the embroidering-frame holder 17.

As was described before, the embroidering frame 16 is fitted in the timing pulley 19 with a piece of cloth 23 held tight between them. The bed 32 of the sewing machine, which accommodates a rotating hook 32, is provided immediately below the needle 15.

Figure 4:
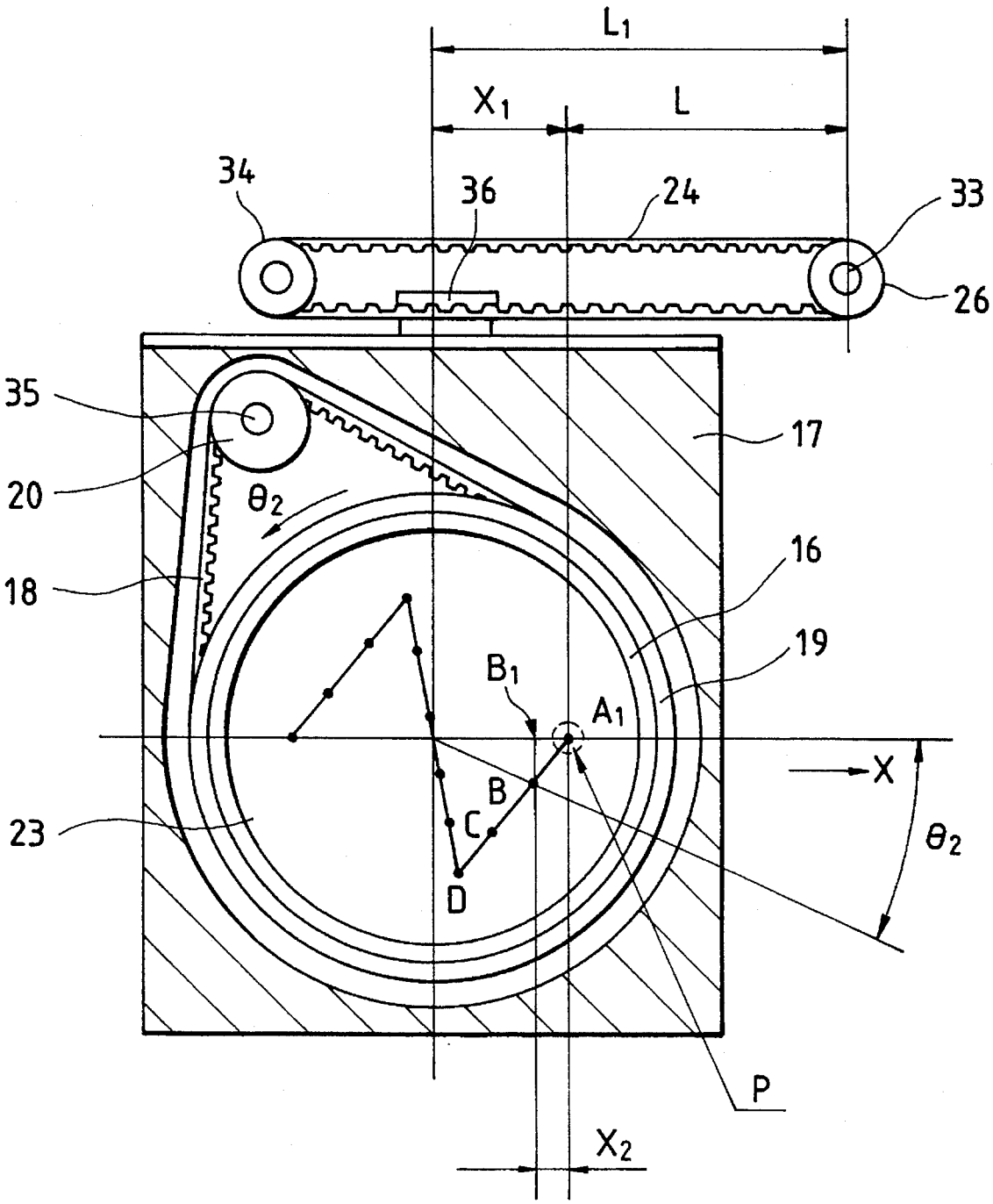
Figure 5:
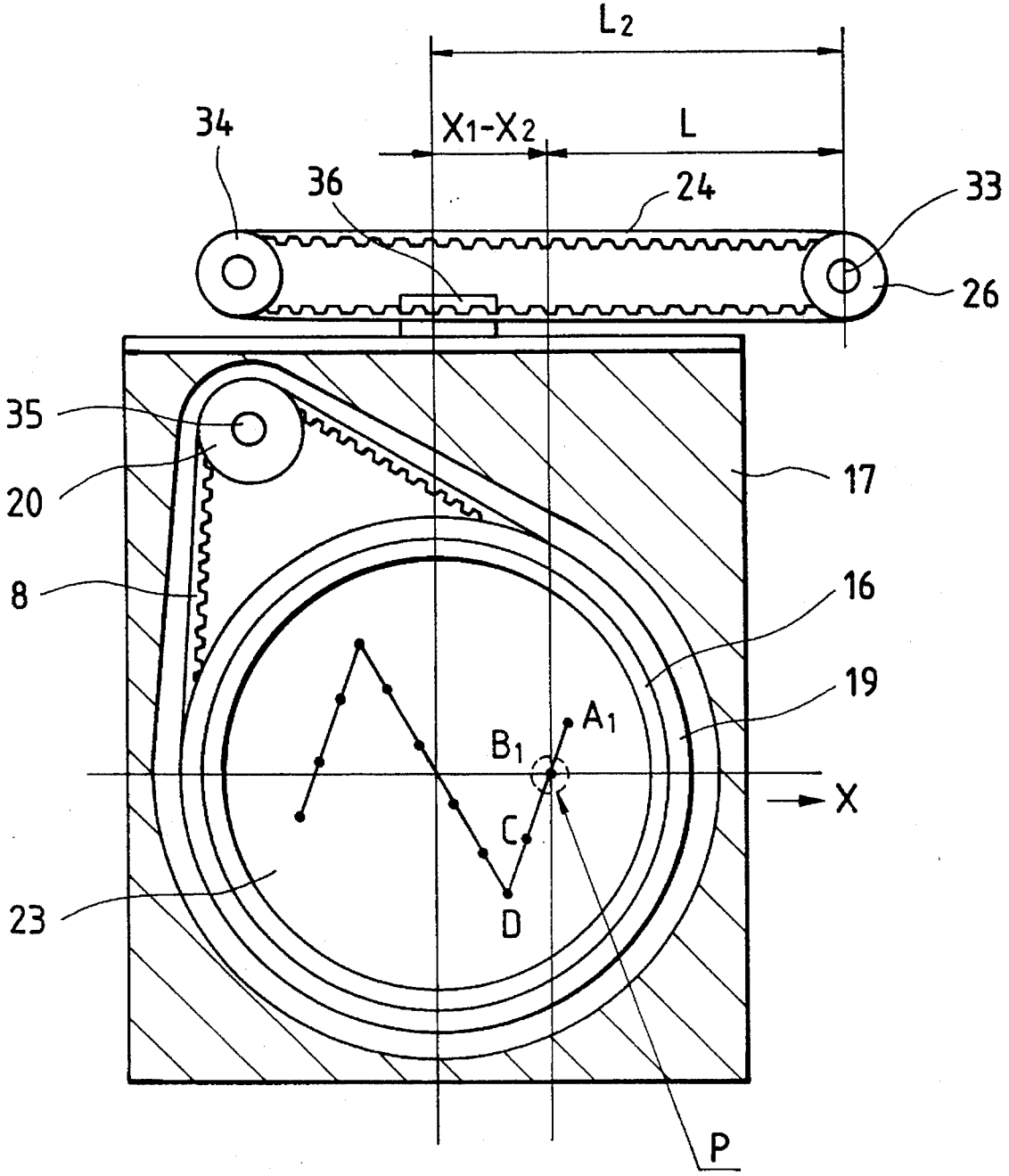

The operation of the embroidering-frame driving device thus constructed will be described with reference to FIGS. 3, 4 and 5.

The center of the embroidering frame is at a distance of L from the rotary shaft 33 of the driving motor 33 in the direction of the arrow X.

Hereinafter, the axis extended through the center of the embroidering frame in the direction of the arrow X will be referred to as an X-axis. In the case of FIG. 3, the position of the center of the embroidering frame 16 is the same as that of the center P of the needle 15. It is assumed that, by way of example, the character "N" having sewing points A, B, C, D, E, F, G, H, I, J, K and L is to be embroidered on a piece of cloth 23 held by the embroidering frame 16.

Figure 3:
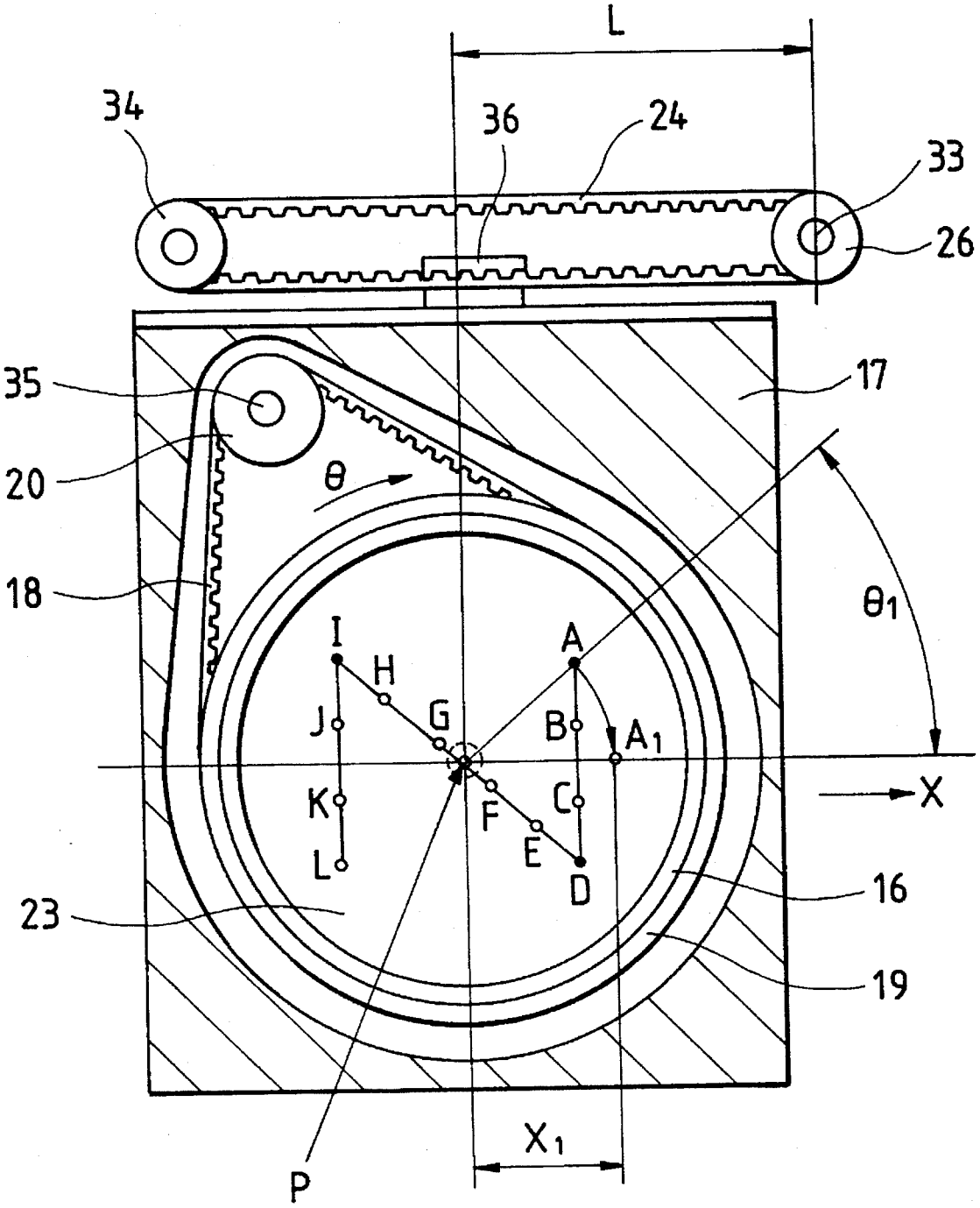
FIGS. 3, 4 and 5 are sectional views of the embroidering-frame driving device for a description of the operation of the latter.

First, in order to sew the point A, the rotating motor 21 is turned through an angle θ1 between the X-axis and the straight line extended from the center of the embroidering frame 16 to the point A, to move the point A to a point A1 on the X-axis as shown in FIG. 3. Thereafter, the driving motor 22 is turned so that the embroidering-frame holder 17 is moved as much as the distance X1 between the needle center P and the point A1. As a result, the needle center P reaches the point A as shown in FIG. 4. Thus, the point A can be sewed. Next, the rotating motor 21 is turned again through an angle θ2 formed between the X-axis and the straight line extended from the center of the embroidering frame to the point B, to move the point B to a point B1 on the X-axis. Under this condition, the driving motor 22 is turned so that the embroidering-frame holder 17 is moved as much as the distance X2 between the needle center P and the point B1. As a result, the needle center P reaches the point B. Thus, the point B can be sewed. For the remaining points C through L, the device is operated in the same way. Thus, the character "N" has been embroidered on the piece of cloth.

In the above-described method, in order to sew the point A (or B) the embroidering frame 16 is turned through the angle θ1 (or θ2), and then the embroidering-frame holder 17 is moved as much as the distance X1 (or X2); however, the invention is not limited thereto or thereby. That is, the embroidering-frame driving device may be so modified that the angle θ1 (or θ2) and the distance X1 (or X2) are obtained in advance, and the motors 21 and 22 are turned at the same time.

The embroidering-frame driving device of the invention has the following advantages:

As was described above, in the embroidering-frame driving device of the invention, the embroidering frame is moved only in one direction. Accordingly, the device may be simple in construction, and the sewing machine equipped with the device is small in size. In addition, the device is light in weight, which makes it possible to increase the speed of movement of the embroidering frame and accordingly the sewing speed (rpm) of the sewing machine. Furthermore, it is unnecessary for the device to be so high in the squareness of its X-axis and Y-axis, and therefore its components are not always required to be high in accuracy, and they may be assembled with relatively low precision. Moreover, in the device of the invention, the embroidering frame is smaller in the range of movement than in the conventional embroidering-frame driving device.

While there has been described in connection with the preferred embodiment of this invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. An embroidering-frame driving device for a sewing machine, comprising:

an embroidering frame for holding cloth stretched tight;

an embroidering-frame holder for holding said embroidering frame; and moving means for moving said embroidering-frame holder with respect to said embroidering frame, said moving means consisting essentially of driving means for driving said embroidering frame holder in only one linear direction with respect to a sewing needle of said sewing machine and rotating means for rotating said embroidering frame with respect to said embroidering-frame holder.

2. An embroidering-frame driving device as claimed in claim 1, wherein said rotating means comprises a rotating motor, a timing pulley fitted between said embroidering frame and said embroidering-frame holder, said embroidering frame being received in said timing pulley, a rotary pulley rotatable by said rotating motor, and a timing belt circumscribing said timing pulley and said rotary pulley, whereby when the rotating motor being rotated, said timing pulley is driven through said rotary pulley and said timing belt to thereby rotate said embroidering frame.

3. An embroidering-frame driving device as claimed in claim 2, wherein said driving means comprises a driving motor, a driving pulley fixedly mounted on a rotary shaft of said driving motor; a driven pulley rotatably mounted on a base of said sewing machine; another timing belt circumscribing said driven pulley and said driving pulley; and a fixing member for fixedly fastening said embroidering-frame holder to said another timing belt, wherein rotation of said driving motor causes said embroidering frame holder to move in said one linear direction.

4. An embroidering-frame driving device as claimed in claim 3, wherein said fixing member comprises a belt fastener, a rail extended in said one direction and fixedly secured to the base, a moving stand slidably mounted on said rail, and a coupling member fixedly fastened to said another timing belt with said belt fastener and fixedly connected to said embroidering-frame holder 17 and said moving stand.

5. A method of controlling an embroidering-frame driving device for a sewing machine, which includes an embroidering frame for holding cloth stretched tight; an embroidering-frame holder for holding said embroidering frame; driving means for driving said embroidering-frame holder in one direction with respect to a sewing needle of said sewing machine; and rotating means for rotating said embroidering frame with respect to said embroidering-frame holder, said method comprising the steps of:

(a) energizing said rotating means until a first sewing point, defining in conjunction with a plurality of additional sewing points an embroidery pattern, is disposed along a straight line which extends parallel to said one direction and passes through said sewing needle (b) energizing said driving means to move said embroidering frame holder in said one direction so that said first sewing point is disposed under said sewing needle; and (c) successively repeating steps (a) and (b) for each of said additional sewing points without moving said embroidering-frame holder in any other direction.

* * * * *

UNITED STATES PATENT AND TRADEMARK OFFICE

CERTIFICATE OF CORRECTION

PATENT NO. : 5,503,093
DATED : April 2, 1996
INVENTOR(S) : Yutaka Katou

It is certified that error appears in the above-indentified patent and that said Letters Patent is hereby corrected as shown below:

On title page,

In [73] Assignee:, change "Tokyo, Japan", to --Kariya-shi, Aichi, Japan--.

In [30] Foreign Application Priority Data, change "5-524793", to --5-324793--.

Signed and Sealed this

Eighth Day of October, 1996

*Attest:*

*Attesting Officer*

BRUCE LEHMAN

*Commissioner of Patents and Trademarks*